United States Patent [19]

Wood

[11] Patent Number: 4,616,222

[45] Date of Patent: Oct. 7, 1986

[54] DISPLAY SIGN ELEMENT WITH ANTI-BOUNCE LIMIT STOP

[75] Inventor: Keith S. Wood, Danville, Ill.

[73] Assignee: Time-O-Matic, Inc., Danville, Ill.

[21] Appl. No.: 543,373

[22] Filed: Oct. 19, 1983

[51] Int. Cl.[4] ..... G08B 5/00; G04C 17/00

[52] U.S. Cl. ..... 340/815.24; 40/449; 40/497; 340/815.27; 340/815.05

[58] Field of Search ..... 340/763, 764, 815.24, 340/815.26, 815.27, 815.29, 815.05, 815.08, 815.1, 815.18, 783; 40/423, 426, 446, 447, 449, 450, 497, 533

[56] References Cited

U.S. PATENT DOCUMENTS

| | | | |
|---|---|---|---|
| 3,975,728 | 8/1976 | Winiow | 340/815.26 |
| 4,163,332 | 8/1979 | Salam | 340/764 X |
| 4,264,906 | 4/1981 | Wakatake | 340/764 |
| 4,318,098 | 3/1982 | McGreevy | 340/764 |
| 4,344,070 | 8/1982 | Forest et al. | 340/764 X |
| 4,417,241 | 11/1983 | Wakatake | 340/764 X |

*Primary Examiner*—Gerald L. Brigance
*Assistant Examiner*—Vincent P. Kovalick
*Attorney, Agent, or Firm*—Russell E. Hattis; Stephen R. Arnold

[57] ABSTRACT

In a display sign including a plurality of rotatable display elements to be flipped between opposite extreme display positions, a bidirectional limit stop for stopping the motion of said display elements at said extreme positions is configured in the form of a bidirectional pendulum. The limit stop is preferably formed by an oversize sleeve coaxially disposed with respect to and depending from a smooth-surface horizontally disposed support member. The rotatable display element is preferably generally planar and configured to strike the opposite sides of the outer surface of the pendulum-forming sleeve along a line passing below the point of support thereof. The resulting pivoting and rotating movement of the pendulum serves to absorb a substantial portion of the angular kinetic energy of the rotating display element, thereby suppressing rebound. A resilient element configured in the form of an O-ring annularly disposed around the outer surface of the hanging sleeve serves to absorb an additional portion of the shock, the sleeve contact-point advancing about the support member with each impulse so as to rotatingly present a fresh portion of the O-ring for impact, thereby spreading wear around the entire O-ring.

10 Claims, 8 Drawing Figures

FIG. 2a
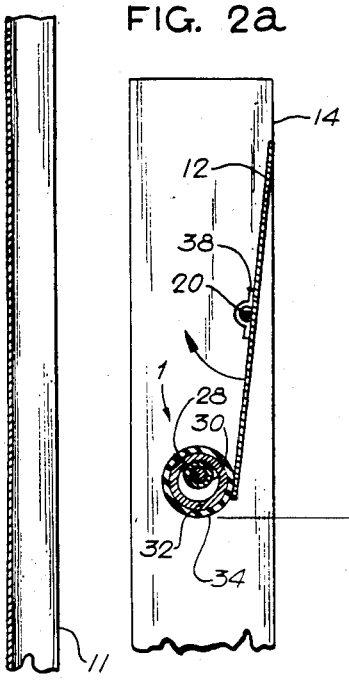
FIG. 2b
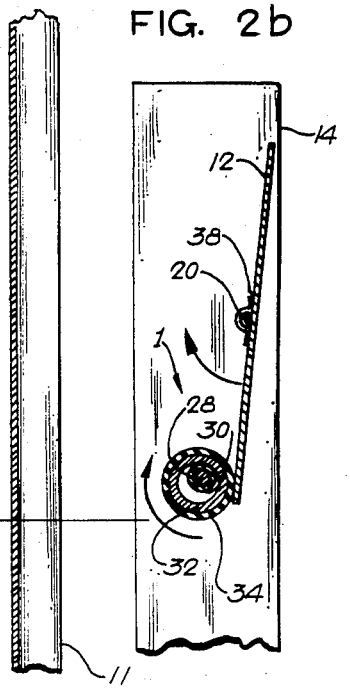
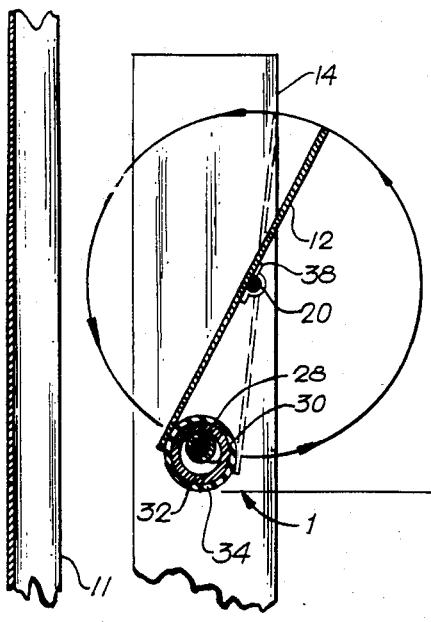
FIG. 2c
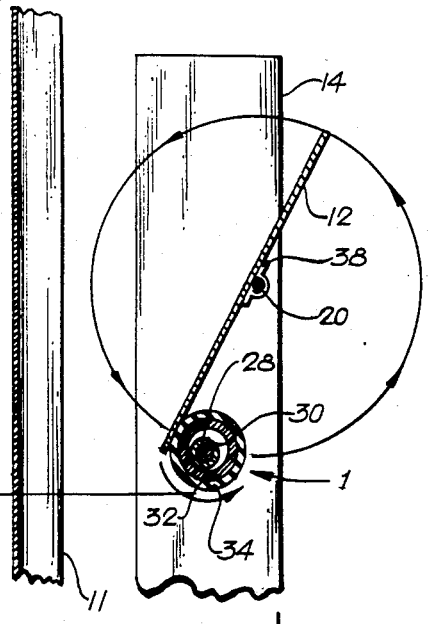
FIG. 2d

DISPLAY SIGN ELEMENT WITH ANTI-BOUNCE LIMIT STOP

TECHNICAL FIELD OF THE INVENTION

The technical field of the invention is electrically operated display signs, in particular those signs wherein the displayed indicia viewed by the observer are created by selective rotational flipping of chosen members of a matrix. Each element is selectively actuated to display one of two opposing faces thereof to the viewer, one presenting a dark, substantially invisible face against a usually similarly colored background, and the other presenting a bright color substantially contrasting with the background color.

BACKGROUND OF THE INVENTION

There are known in the art a variety of outdoor signs for presenting to the viewer large display numerals, letters, or text, one common version being an outdoor sign that portrays the time of day, the time being updated on a minute by minute basis. One such type of sign, characterized by a substantial economy of power as contrasted with self luminous displays, is disclosed in U.S. Pat. No. 4,015,255 issued to Wood March 29, 1977, wherein each character to be displayed is formed from a matrix of closely spaced discs rotatable about an axis normal to the viewing axis. One side of each disc is lightly colored, the other side being dark. Each disc is selectively actuated by a momentarily energized electromagnetic actuator to present to the observer on command either the bright side of the associated disc or its dark side. By well-known means, selected groups of discs are driven to present their appropriate faces outward so as to present, when seen from a distance, a desired number or letter.

Because of the nature of the electrical control sequence that is necessary to actuate such arrays from one configuration to the next, particularly where rapidly changing displays are involved, it is desirable that each individual indicating element be rotated quickly and positively from one of its two positions to the other, and with a minimum of energy expenditure. Until all elements of a given configuration have been actuated to their desired new positions, they cannot be subsequently re-actuated to form a new character. As will be discussed below, the requirement for rapid positive actuation has hitherto resulted in excessive power demand by the electromagnetic actuators. This problem is intimately related to the poor arresting and rebound properties of the rotation-terminating limit stops hitherto known in the art, as will be explained.

Displays of the type mentioned in the above cited patent have their individual elements actuated by mounting a permanent magnet on the rotating display element, and have an associated solenoid mounted on an adjacent stationary part of the sign structure. The solenoid is energized in one direction or the other to rotate the magnet and its associated indicating device in the desired direction.

A problem arises in securing an accurate, reliable bounce-free termination of element rotation to avoid sign-change flutter, while at the same time holding energy expenditure to a minimum. In practice this has proven to be extremely difficult to obtain. Some form of limit stop must be employed to arrest the motion of the display element in both directions, and the use of conventional stops gives rise to flutter problems. A positive locking feature can be secured at the expense of additional power at a given sign-changing speed if a strongly magnetizable (high remanence) core is used in the solenoid, so that upon removal of the current excitation the core remains permanently magnetized to maintain a strong attractive force against the associated display element magnet, thereby maintaining this strong attractive force between successive energizations to prevent rebound.

As is well known to those knowledgeable in the electromagnetic art, each successive reversal of solenoid current to drive the element in the opposite direction must not only magnetize the core in the opposite direction, but also it must wipe out the previous residual induction (remanence) in the solenoid core. Thus, the electrical power demand of the system is increased to an undesirable degree. Alternatively, if a magnetically "soft" solenoid core is employed, a long duration holding current must be maintained in the solenoid throughout the possible rebound period, again adding to the power requirements of the system.

The applicants have experimented with a variety of resilient stop limiter elements to absorb the kinetic energy of the indicating display elements at the end of a rotation stroke, but prior to the present invention the applicants found none that satisfactorily eliminates rebound unless used in conjunction the previously mentioned energy-wasteful approaches. Moreover, any such resilient stop limiting element must undergo a very great number of impacts during its useful life without undergoing substantial deterioration. Thus, a wear-resistant design is needed in such elements in order to prolong their useful life.

It would be reasonable to assume that an adequate suppression of rebound could be achieved simply by causing the rotating element to engage a spring loaded member of intermediate mass, elementary momentum transfer from the element to the mass thus suppressing the rebound. Although theoretically attractive, the applicants have repeatedly attempted using various limit stop designs based upon such principles without success to achieve the necessary anti-rebound properties.

Thus, there has been a need for a shock absorbing limit stop for such display elements which has substantially improved wearing properties, while still allowing rebound-free termination of an impulsive actuation stroke initiated by momentary actuation of the actuating solenoid, without requiring a subsequent holding current or permanent magnetization to prevent rebound. To the applicant's knowledge, prior to the invention which is the subject matter of this disclosure, no satisfactory solution to these problems had been found.

SUMMARY OF THE INVENTION

According to a feature of the invention, a limit stop for a flip sign display element, preferably configured in the form of a generally planar member, is constructed in the form of a uniquely shaped pendulum comprising a mechanical impulse-absorbing member depending from a pivot and disposed to be struck by the display element at the end of each flip-over motion of the display element involved. Because of the known property that the restoring force of a pendulum increases with its displacement from its static point, the display element encounters a progressively increasing decelerating force to terminate its movement, resulting in a marked improvement in the rebound properties of the limit stop of the invention, as compared with conventional limit stops.

According to a further feature of the invention, and as described in the preferred embodiment, the pendulum takes the form of a horizontally disposed sleeve held loosely captive around a horizontally disposed support member, preferably configured in the form of a cylindrical rod, so that the sleeve hangs loosely pivoted about the upper outer surface of the rod. By positioning the sleeve with respect to the display element so that the direction of the contacting impulse of the display element against the sleeve passes below the pivot point, the sleeve proceeds to rotate about a movable pivoting axis generally lying along the upper outer surface of the support element to provide a pendulum action. Furthermore, because of the loose pivoting, not only does the limit stop provide a progressively increasing restoring force over the initial limit of its travel, but it is capable of substantial net rotation after each impact so as to dissipate the kinetic energy of the display element as frictional losses as the sleeve slips about the rod.

According to a further feature of the invention, the sleeve is provided with a resilient property, in the exemplary form this resilient property being achieved by disposing annularly in a captive manner an elastomeric O-ring about the central portion of the sleeve, the elastomeric property of the O-ring providing additional damping to the system. Because of the previously mentioned impulsive slippage between the sleeve and the support member with each impulse, resulting in a rotation of the sleeve with each impulse received, the impact area of successive impulses is applied along the entire annulus of the elastomeric element. This spreads the wear completely along this element, so as to prolong its useful life.

According to a further feature of the invention, particularly applicable to those cases where the display elements rotate approximately 180°, alternate sides of the limit stop are used to provide the limiting action for both cycles of the display element, the pendulum action being inherently bidirectional.

Thus, by an inexpensive and simple means a bidirectional limit stop is provided for flip sign display elements, the stop having markedly improved rebound properties over those of the prior art. Also, the stop design described has wear-resistant properties, and in general offers a marked improvement over prior attempted solutions to this problem. Moreover, when magnetic actuation systems are employed using a solenoid to rotate the display element by supplying a torque to a permanent magnet mounted on the element, there is no necessity for holding the solenoid overly long in an energized condition at the end of an actuation stroke to prevent rebound. A substantial improvement in the power efficiency of individual solenoid actuation systems is thus achieved, as well as a substantial increase in the allowable sequential actuation rate of the display element, since in general such elements cannot be actuated to a new configuration until they have been stablized in the previous configuration.

Other advantages features of the invention will become apparent upon making reference to the description to follow, the drawings, and the claims.

Figures 1, 3A:
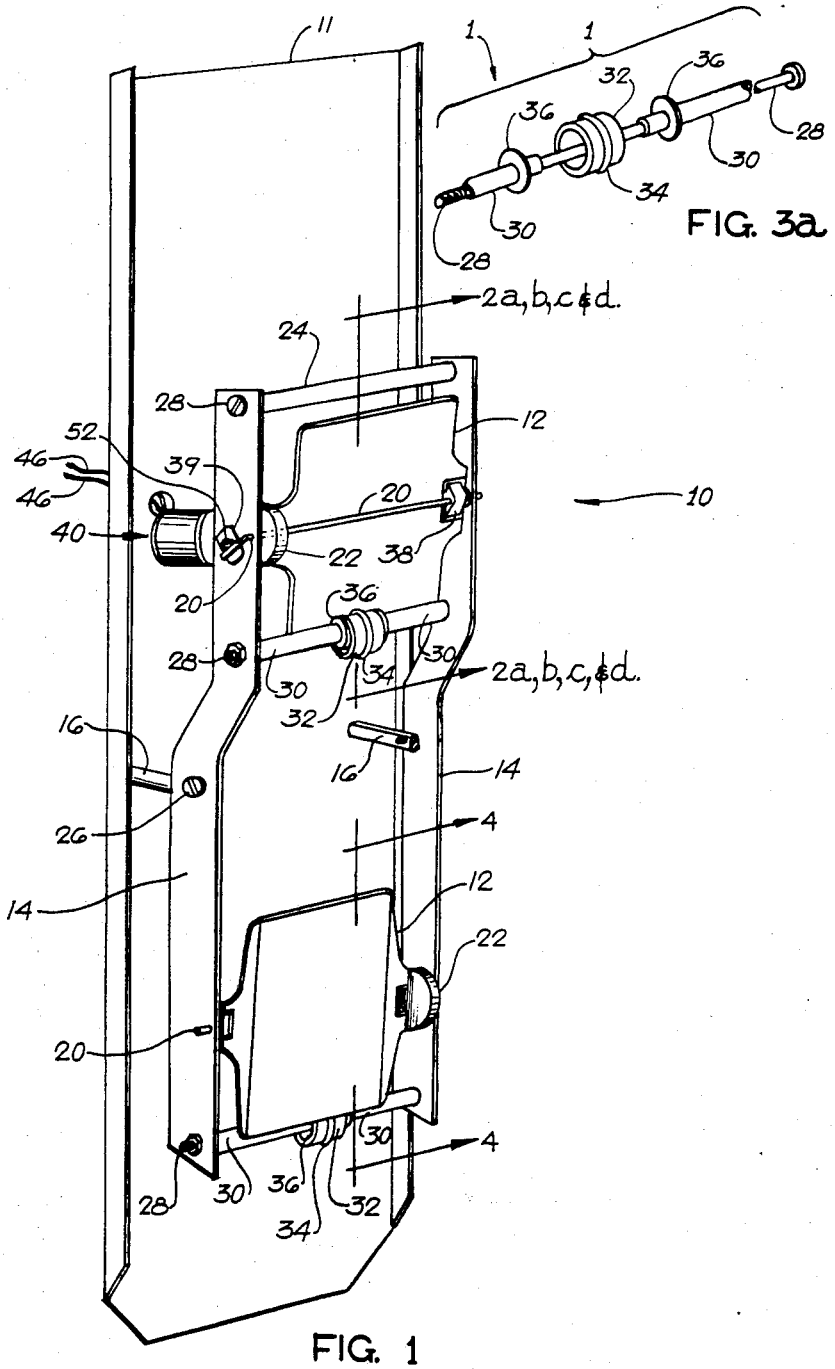
FIG. 1 is a perspective view of a pair of magnetically actuated indicating display elements pivotally mounted on a carrier, the carrier being supported upon a frame, and further showing a pair of limit stops of the invention contactingly touching the lower faces of the indicating elements.

FIGS. *2a–2d* are cross section views of one of the limit stops of FIG. 1 moving under impulsive actuation delivered by a rotating display element, the element being driven from either of two directions to a limiting condition.

FIGS. *3a* and *3b* are an exploded perspective view and a cross section assembled view of the limit stop shown in FIGS. 1–2*d*.

Figure 4:
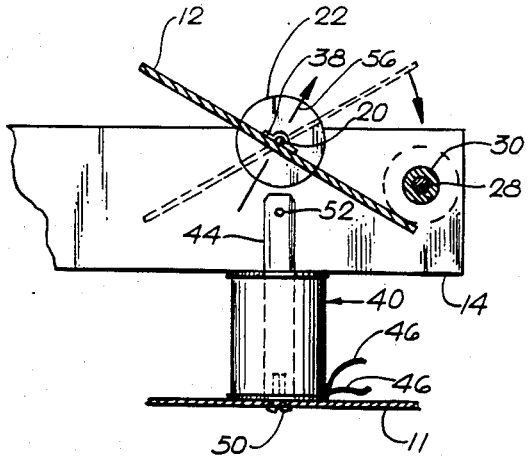

FIG. 4 is a cross section view showing a magnetic sign solenoid actuator disposed to rotate one of the indicating elements shown in FIG. 1 by rotating a cylindrical magnet attached thereto.

DETAILED DESCRIPTION OF THE INVENTION

The overall subject of the invention is an improved limit stop for magnetically operated display signs of the type generally shown in FIG. 1, wherein indicating elements 12, here shown as rectangular planar elements, are selectively rotated about pivot rods 20 to present to the observer opposite faces of the indicating element. The particular display element shown in FIG. 1 is a sign element designed to portray in slightly staggered form either a colon or a period, according to the state of the actuation of the two indicating elements 12. The assembly shown is thus designed to be oriented with the long axis thereof in a vertical direction.

Rotation of the elements 12 is secured by applying a rotating torque to disc magnets 22 secured to the indicating elements, the torque being provided by solenoid units 40 disposed close to the magnets 22 and energizeable in opposite directions, according to the direction of rotation desired. In FIG. 1 the indicating elements 12 are shown pivotally supported on pivot rods 20 with their associated magnets 22. The magnets are preferably configured as cylindrical disc coaxially positioned with respect to the rods 20 and secured by adhesive means to one end of the associated indicating display elements 12. The pivot rods extend transversely between, and are secured by clips 39 to a pair of generally strap-like parallel spaced carrier elements 14 disposed on either side of the indicating elements 12, the carrier elements being held in a fixed spaced apart relationship at one end by a tie rod 24 mounted therebetween and attached to the carrier straps by screws 28. The carrier straps 14 are mounted at a standoff distance from a generally planar support frame 11 by means of standoff posts 16 secured to the frame by conventional means (not shown) and secured to the carrier straps at the opposite ends of the posts by screws 26.

FIG. 4 shows further details of the magnetic actuation system, wherein a ferromagnetic support post 44 having "soft" magnetic properties and extending outward from the frame 11 and held captive thereto by screw 50 serves as the core of each solenoid unit 40, thus providing further support for the carrier 14 as well as extending the region of external magnetic field produced by the solenoid unit 40 when actuated via current flow through leads 46 leading to a coil (not shown) and fed by an external power source (not shown). The magnetic field produced at the upper end of the core post 44 as shown in FIG. 4 is thus strong proximate to the cylindrical magnet 22. The magnet 22 shown in FIG. 4 is permanently magnetized to have north and south pole directions generally perpendicular to the plane of the indicating element 12 as indicated by the arrow 56. According to the direction of the current supplied to the solenoid coil, the magnet 22, and hence the indicating element 12, will be urged either into a clockwise or counterclockwise rotation.

As stated in the Background of Invention, when such a sign element is driven to rotation by such an actuator, a recurring problem is to reconcile the requirements for rapid actuation speed, a highly desirable feature if the sign is to be actuated to rapidly changing display conditions, with the further requirement that the rotation be quickly and reliably terminated at the end of the rotation thereof. Some sort of limit stop is invariably employed for this purpose, the purpose of the limit stop being not only to arrest the motion in a proper position, but also to absorb the angular kinetic energy in the indicating element without at the same time inducing a substantial measure of rebound, causing the indicating element to flutter for a substantial period of time before settling down.

Customary solutions to this problem have employed the use of various elastic bumpers to supply this limiting action. A great variety of elastomeric limits stops have been experimentally tested and discarded not only for failure to adequately suppress rebound, but also because of deterioration of such members over a period of time under the effect of repeated impacts. Even in those conditions where such deterioration is held to a tolerable degree, use of an elastomer alone has not proven to be adequate to provide sufficient damping during high speed actuation of the indicating elements.

Figure 3B:
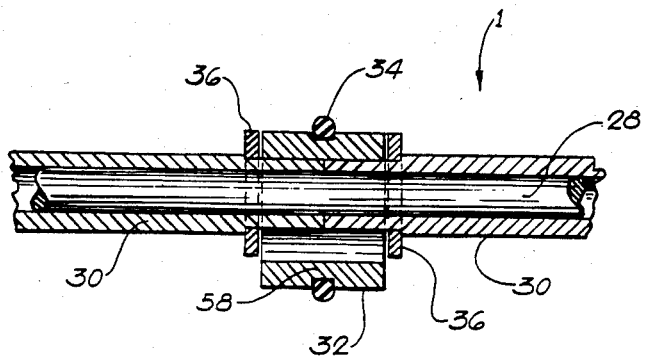

The present invention solves this problem by the novel method of fabricating the limit stop in the form of a loosely coupled pendulum. FIGS. 3*a* and 3*b* show respectively an exploded assembly view of a limit stop assembly 1, comprising a pair of hollow cylindrical bushings 30 disposed about a tie rod 28, the tie rod being affixed at either end to opposing carrier elements 14 generally below the associated pivot rod 20 as shown in FIG. 1. In the embodiment shown the indicating elements 12 are generally planar, and are symetrically mounted about the pivot rod 20 as shown in FIG. 4. Referring again to FIGS. 3*a* and 3*b*, the bushings 30 each have mounted thereon close to their interior cylindrical ends a pair of radially outwardly extending washers 36. Between these two washers 36 is loosely and generally coaxially disposed a cylindrical sleeve 32 having an annular compressible elastomeric O-ring 34 centrally disposed therearound in a groove 58, the sleeve hanging loosely from the innermost sections of the two bushings 30 as a pendulum pivoted generally about the top smooth surfaces of the bushing inner ends.

FIG. 2*a* is a cross section view of a limit stop 1 with the lower end of the display element 12 making initial contact therewith. FIG. 2*b* shows the effect of driving the display element 12 forcibly against the stop 1, thereby striking the O ring (resilient member) 34 to actuate the sleeve 32 to a clockwise motion. Broadly viewed, the limit stop 1 thus has the properties of a pendulum, since the center of mass of the sleeve 32 and O-ring 34 are disposed below the pivot point, i.e. the point of contact between the inside bore of the sleeve 32 and the upper surface of the bushing 30, although, as can be seen, the pivot point executes a displacement in a clockwise direction as viewed in FIGS. 2 and 2*b*.

It is, of course, a known property of pendulums in general that when driven from a rest position the restoring force arising from the relationship of the center of mass to the pivot increases as the pendulum undergoes additional displacement. Thus, as the indicating element 12 strikes the O-ring 34 and thereafter continues to drive the sleeve 32 in a generally clockwise direction, it is clear that the restoring force of the pendulum will undergo a progressive increase in value. It will further be noted that as a result of the rotation of the sleeve, the elastomeric element 34 rotates tangentially against the face of the indicator element 12, thereby dissipating a fraction of the angular kinetic energy in the form of frictional losses.

FIG. 2*c* shows the indicator element 12 in its reversed position, again being lightly held in position by the attraction of the pole or region of the magnet 22 for the soft permeable core post 44 as shown in FIG. 4. FIG. 2*d* shows the pendulum driven to the point where the pivot point is below the center of mass of the sleeve system. The frictional drag force between the sleeve and the bushings 30 and the previously mentioned drag force between the O ring 34 and the display element 12 dissipates the kinetic energy of the applied impulse. This provision for a measure of net rotation in combination with the pendulum pivot action with each actuation has proven to be highly effective in suppressing rebound, and also causes the wear to be spread around the entire outer surface of the O ring 34, thus prolonging the useful life of the system.

Thus, by combining the progressively increasing restoring force action of a pendulum with provision allowing a degree of slippage to the system to absorb the energy impulse and to advance a surface mounted elastomer so as to spread the resulting wear around the entire surface of the elastomeric annulus, a limit stop is achieved which not only adequately suppresses element rebound, but which is characterized by very long life as well.

The improved rebound properties allow a substantially reduced net actuating power requirement for the solenoid actuating system. By use of such stop limiters, the speed and useful life of signs employing such indicating elements are substantially improved for a given system power requirement. Moreover, as may be readily seen in the drawings, such limiter elements may readily be fabricated by elementary manufacturing techniques at minimal costs from inexpensive materials.

While for the purpose of illustration, various forms of this invention have been disclosed, other forms thereof may become apparent to those skilled in the art upon reference to this disclosure and, therefore, this invention shall be limited only by scope of the appended claims.

Thus, for example, the sleeve 32 and the O ring 34 could in principle be replaced by a single resilient tube; however, the employment of a rigid sleeve and surrounding elastomer as shown in the drawings is believed to represent a superior structure. Moreover, it has been established that the limit stop assembly 1 may alternatively be placed generally above the pivot rod 20, and the stop appears to function even better in this position. In either disposition, however, the stop is disposed so that the impulse initially transmitted to the elastomeric O-ring 58 is directed to pass below the top of the bushings 30, i.e. below the initial or static pivot point. The general discription of the sleeve motion as previously set forth applies with equal validity to both cases.

I claim:

1. In a display sign including a plurality of rotatable display units to be flipped between opposite extreme display positions, each said unit being rotatably mounted for rotation in either direction about an axis of rotation by cyclic actuating means, each said unit having associated therewith a display element having contrasting appearing surfaces on opposite sides thereof to present one or the other of said contrasting surfaces to view and having associate therewith limit stop means for terminating at said extreme positions the rotation thereof induced by said actuating means, the improvement comprising pivot-forming means associated with said limit stop means and a display element motion-arresting member pivotally movable about said pivot-forming means and configured to hang therebelow as a pendulum, said arresting member being disposed so that a portion of said rotatable display unit strikes said arresting member during a terminal portion of rotational movement from one of said extreme positions to the other to transfer at least a portion of the angular kinetic energy of said display unit to said arresting member as a pendulum pivoting motion so as to assist in termination the movement of said display unit at said extreme positions.

2. The display sign of claim 1 wherein said pivot-forming means is configured to allow a net sliding rotation of said arresting member in addition to said pendulum-pivoting motion thereof when struck by its associated display unit, so that said net rotation serves to dissipate by frictional losses a portion of said kinetic energy transferred to said arresting member.

3. The display sign of claims 1 or 2 wherein said arresting member includes an elastomeric portion disposed thereon so as to be struck by said display unit.

4. The display sign of claim 1 wherein said axis of rotation of said display element is disposed horizontally, and said limit stop incudes: a first smooth-surface horizontally extending pivot-forming support member fixedly disposed parallel to said axis of rotation and generally vertically therebelow, and said arresting member includes a hollow sleeve surrounding and loosely hanging from said support member, said sleeve being disposed with respect to said associated display unit so as to be struck at at least a portion thereof by said display unit so that a mechanical impulse is transmitted to said sleeve to act along a line passing below the top surface of said pivot-forming support member.

5. The display sign of claim 4 wherein said sleeve has annularly disposed about at least a portion of the outer surface thereof resilient means for interceptingly absorbing a portion of the mechanical impulse transmitted to said sleeve by the impact of said display element.

6. The display sign of claim 5, wherein said resilient means includes at least one elastomeric O-ring fixedly secured about the outer surface of said sleeve.

7. The display sign of claims 5 or 6 wherein said display unit is configured to have portions thereof disposed to strike said resilient means on opposite sides of said sleeve when said display unit is flipped to its opposite extreme positions, and so that said mechanical impulse is directed below said top surface of said pivot-forming support member when said display unit strikes said sleeve on either of said opposite sides.

8. The display sign of claim 1 wherein said display element is configured as a generally planar member rotatable to limiting positions arrestingly striking against said limit stop to present selectively either of the two major faces thereof in a given direction, said actuating means rotating said element against said limit stop in either direction.

9. The display sign of claim 1 wherein said actuating means includes a permanent magnet affixed to said display unit and rotatable therewith, and a d.c. electromagnet energizable by an electrical current and disposed to apply a reversible force to said magnet so as to rotate said display unit toward said limit stop in either direction according to the direction of current flow in said electromagnet.

10. The display sign of claim 6 wherein said pivot-forming means is configured to allow said sleeve and resilient means to undergo a net sliding rotation in addition to a pendulum-pivoting motion when struck by its associated display unit, so that said net rotation serves to dissipate a portion of said kinetic energy transferred to said arresting member by sliding frictional losses between said sleeve and said pivot-forming means.

* * * * *